US007441933B2

(12) United States Patent
Tsukamoto et al.

(10) Patent No.: US 7,441,933 B2
(45) Date of Patent: Oct. 28, 2008

(54) VEHICULAR LAMP

(75) Inventors: Hironori Tsukamoto, Shizuoka (JP); Tsukasa Tokida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 7 days.

(21) Appl. No.: 11/589,663

(22) Filed: Oct. 30, 2006

(65) Prior Publication Data

US 2007/0109806 A1 May 17, 2007

(30) Foreign Application Priority Data

Nov. 16, 2005 (JP) ..... 2005-331170

(51) Int. Cl.
*F21S 8/10* (2006.01)

(52) U.S. Cl. ..... 362/548; 362/545; 362/800

(58) Field of Classification Search ..... 362/545, 362/800, 249, 548
See application file for complete search history.

(56) References Cited

U.S. PATENT DOCUMENTS 7,237,935 B2 * 7/2007 Ito et al. ..... 362/547
7,290,910 B1 * 11/2007 Hohl-AbiChedid et al. . 362/541
2007/0109806 A1 * 5/2007 Tsukamoto et al. ..... 362/545

FOREIGN PATENT DOCUMENTS

JP 2005-44777 2/2005

* cited by examiner

*Primary Examiner*—Anabel M Ton
(74) *Attorney, Agent, or Firm*—William L. Androlia

(57) ABSTRACT

A vehicular lamp 10 including an LED module 60 that is a light source and a power supply socket 70 for connecting the LED module to a power supply. The LED module is made of an LED substrate 61, an LED 62 mounted on the LED substrate, a pair of positive and negative current-conducting parts 63 connected to the LED and formed on both sides of the LED. The power supply socket includes a base body 71 made from an insulating material and a pair of positive and negative terminals 72 held in a pair of holding portions 73 of the base body. When the LED module is set in the power supply socket, the holding portions of power supply socket hold the side edge portions of the LED module, and the pair of positive and negative terminals come into contact with the current-conducting parts of the LED module.

5 Claims, 16 Drawing Sheets

VEHICULAR LAMP

BACKGROUND OF THE INVENTION

1. Field of the Invention

The present invention relates to a vehicular lamp and more particularly to a vehicular lamp that uses a light-emitting diode (called an "LED") as its light source and that facilitates assembly and exchange of the light source section of the lamp.

2. Description of the Related Art

As light sources for vehicular lamps such as automobile lamps, tungsten incandescent light bulbs, halogen light bulbs, discharge bulbs or the like are generally used. However, factors including the development of LEDs with high brightness and lowered costs have helped steadily expand the use of LEDs as light sources for vehicular lamps.

Vehicular lamps must radiate light over a relatively broad area, and headlamps in particular require high output power. As a result, LEDs are used in a single lamp, and normally one or more LED substrates mounted with a plurality of LEDs are installed in a lamp chamber.

However, vehicular lamps that use conventional LEDs of the above-described structure as their light sources have different sizes and shapes depending on the different vehicle models in which the lamps are used. For this reason, there is no uniformity in the number of LEDs required or in layout patterns, and in addition LED substrates have difference sizes and shapes, and the number of LEDs mounted therein also varies. As a result, manufacturers are unable to make selections but to design and use lamps specifically designed to a particular vehicle model, which makes cost increases unavoidable.

There are other problems with the cost and burden of maintenance if even one LED is damaged. This is because the LED substrate with LEDs mounted must be removed so that the damaged LED is replaced or because the entire LED substrate mounted with LEDs must be exchanged, etc.

BRIEF SUMMARY OF THE INVENTION

Accordingly, it is an object of the present invention to provide a vehicular lamp that facilitates the assembly and exchange of the light source section which uses LEDs as the light source.

The above object is accomplished by a unique structure of the present invention for a vehicular lamp that includes an LED module, which is the light source, and a power supply socket, which is for connecting the LED module to a power supply circuit; and in this structure, the LED module is comprised of an LED substrate generally shaped as a flat plate, an LED mounted on the LED substrate, and a pair of positive and negative current-conducting parts which are connected to the LED and formed on both sides of the LED on the LED substrate;

the power supply socket is comprised of a base body, which is made from an insulating material and is formed with a pair of holding portions into which the LED substrate side edge portions formed with the current-conducting parts are insertable, and a pair of positive and negative terminals, which contact the pair of positive and negative current-conducting parts of the LED module and are held by the base body of the power supply socket; and when the LED substrate is installed in the holding portions of the base body of the power supply socket, the pair of the current-conducting parts of the LED substrate respectively and separately contacts the pair of contact terminals and the side edge portions of the LED substrate is held is by the holding portions.

In the vehicular lamp of the present invention as describe above, attachment and detachment of the LED module to and from the power supply socket, as well as a connection of the LED of the LED module to the contact terminals of the power supply socket, are achieved by simply inserting the LED module side edge portions formed with the current-conducting parts into the holding portion of the power supply socket.

More specifically, in the vehicular lamp of the present invention, since the attachment and detachment of the LED module to and from the power supply socket, as well as a connection of the LED to the contact terminals of the power supply socket, are achieved by simply inserting the side edge portions of the LED module into the holding portions of the power supply socket, it is only necessary that the lamp body has power supply socket holding portions that are for installing a required (or desired) number of LEDs at required (or desired) positions in the lamp body; and with this structure, it is possible to standardize the LED module and the power supply socket and also lend versatility to the LED module and the power supply socket. As a consequence, the LED module and the power supply socket can be mass-produced and the manufacturing costs can be reduced. Also, even if one LED is damaged, in the present invention, only the LED module mounted with the damaged LED is replaced. Moreover, as described above, attachment (and thus removal as well) of the LED module to the power socket is done extremely simple.

Furthermore, in the vehicular lamp of the present invention, the LED substrate has a generally four-cornered outer shape (or square shape), and its two opposing side edge portions have the current-conducting parts; and on the other hand, the holding portions of the base body of the power supply socket are formed into a channel shape so that their or openings face each other; accordingly, the LED substrate side edge portions formed with the current-conducting part are held in these holding portions of the base body of the power supply by the contact terminals or between one of the contact terminals and one of the holding portion. Thus, in the present invention, the structures of the LED module and the power supply socket are both simple and can be constructed at low cost.

Furthermore, in the vehicular lamp of the present invention, the contact terminals are made from a material that has a spring elasticity, and they have elastic contact pieces that elastically contact the LED substrate side edge portions that are formed with the current-conducting parts. Accordingly, the LED substrate can be held in the holding portions of the power supply socket by the elasticity of the elastic contact pieces of the contact terminals, and there is no need to separately provide a structure for holding the LED module in the power supply socket. As a result, the structure of the power supply socket can be simple, and the manufacturing cost of the lamp can be low.

In addition, according to the present invention, the base body of the power supply socket has an opening that allows the top surface of the LED-mounted surface of the LED substrate to be exposed when the LED substrate is set in the power supply socket. Accordingly, heat generated by light emitted from the LED can be easily released through the opening.

DETAILED DESCRIPTION OF THE INVENTION

Hereinafter, best modes for carrying out the present invention will be described with reference to the accompanying drawings. The embodiments of the present invention will be described on an automobile headlamp.

Figure 1:
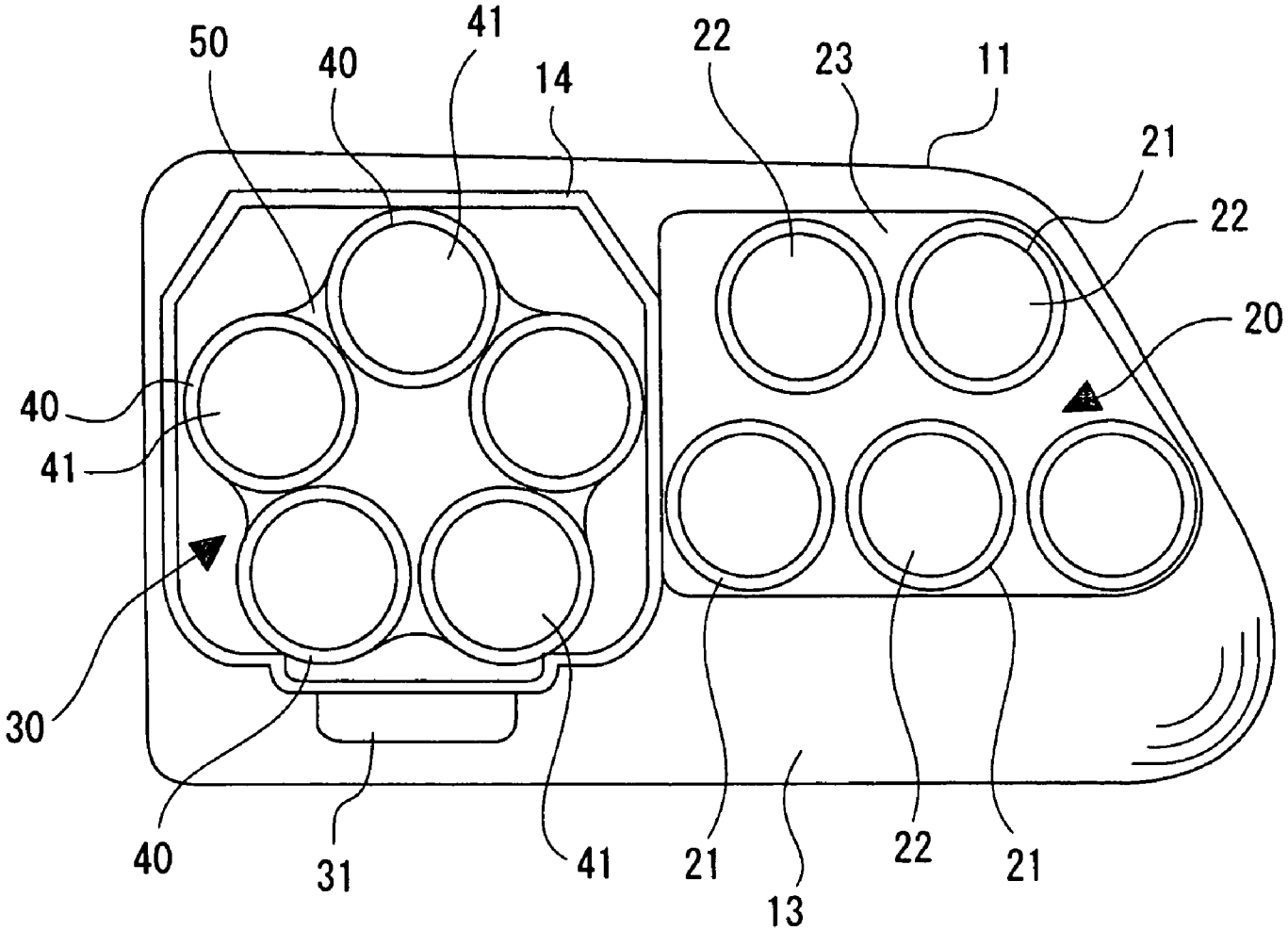
FIG. 1 shows an embodiment of a vehicular lamp according to the present invention, being a generally front elevational view with a transparent cover omitted.
Figure 2:
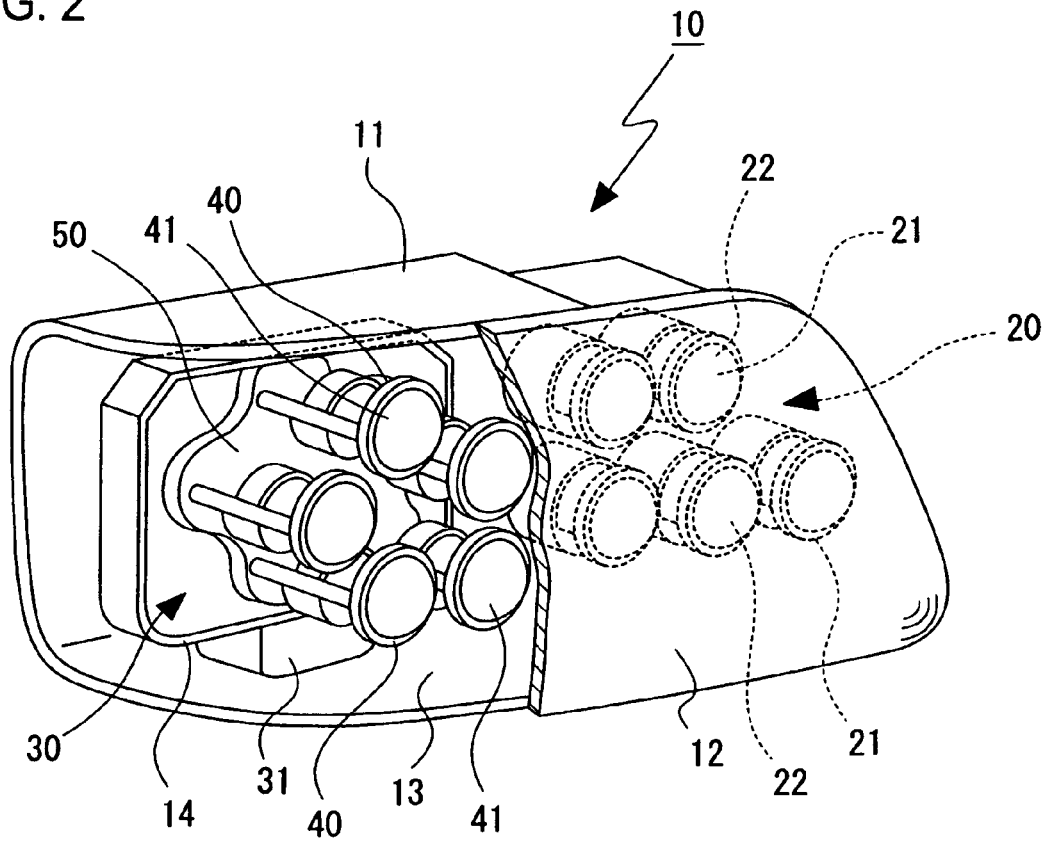
FIG. 2 is a generally perspective view with a part of the transparent cover cut away.

As shown in FIGS. 1 and 2, the automobile headlamp 10 of the shown embodiment is comprised of a lamp housing 11 and a translucent cover 12 that covers the entire front face of the lamp housing 11, and a high-beam lamp 20 and a low-beam lamp 30 are provided inside the lamp chamber 13 that is defined by the lamp housing 11 and the translucent cover 12. The high-beam lamp 20 is formed with five light source units 21 that are aligned in two rows, two light source units in the top row and three in the bottom, and LEDs (not shown) are used as the light source of the high-beam lamp 20. By combining patterns of light radiated from the five light source units 21, a high-beam light distribution pattern is obtained. On the other hand, the low-beam lamp 30 includes five light source units 40 that use LEDs as the light source, and these five light source units 40 are put in a generally annular layout.

In the lamp chamber 13, an inner panel (not shown) known as a bezel is disposed so that it is adjacent to the inner side of the translucent cover 12. The inner panel has a circular opening that faces the front of the light source units 21 and 40 of the respective lamps 20 and 30, so that the front of the light source units 21 and 40 other than their front ends is covered and attains a so-called hidden state.

Each one of the light source units 21 making the high-beam lamp 20 as well as each one of the light source unit 40 making the low-beam lamp 30 are respectively formed as a projection type light-radiating units that respectively have projection lens 22 and 41 on the respective front ends thereof.

Figure 3:
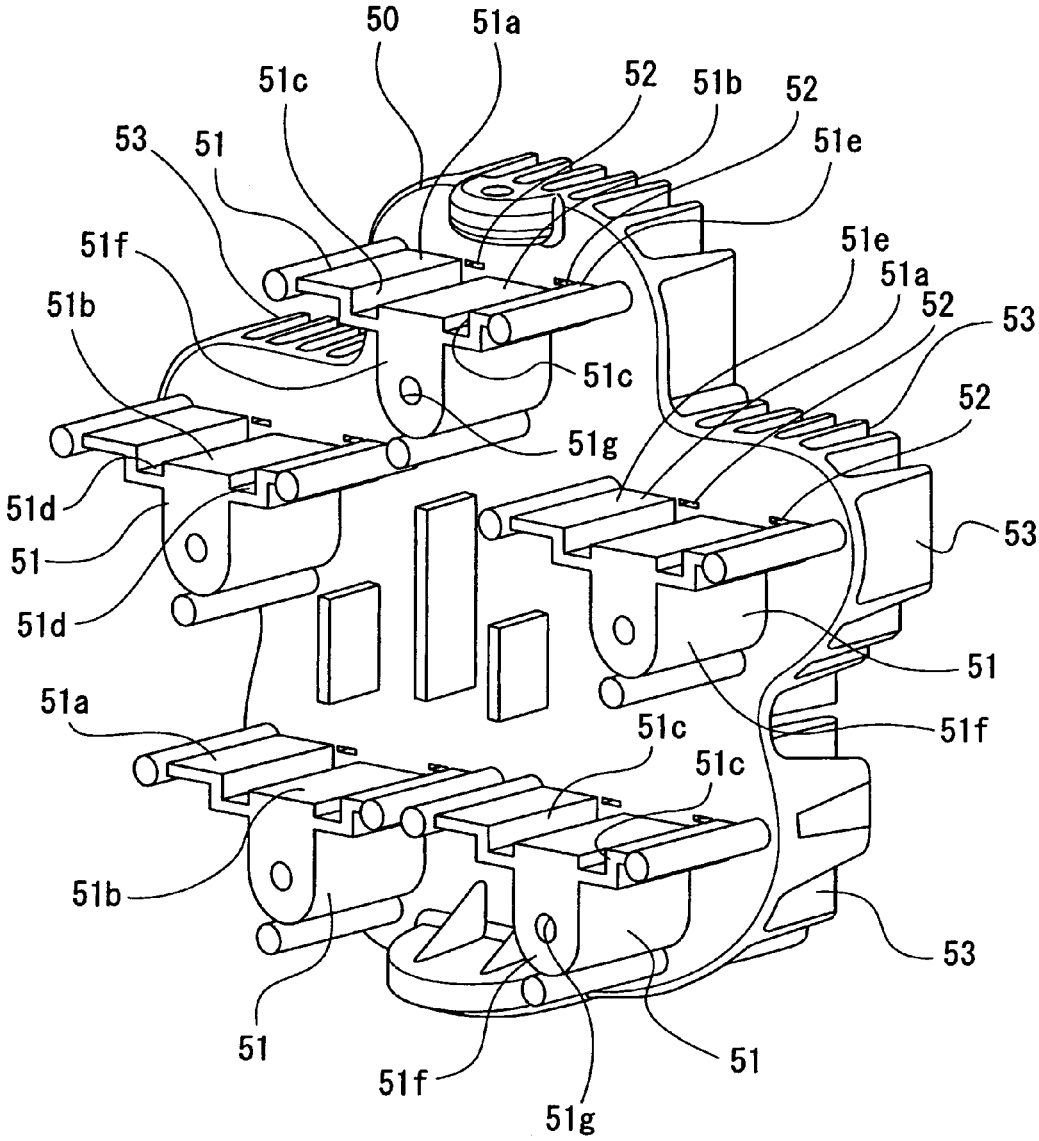
FIG. 3 is a perspective view of a lamp bracket for a low-beam lamp.

The five light source units 40 in the low-beam lamp 30 are, as seen from FIG. 2, provided on a lamp bracket 50 that is shown in detail in FIG. 3. The lamp bracket 50 is provided on an aluminum die-cast lamp frame 14 so that the bracket 50 is rotatable in the horizontal direction, the die-cast lamp frame 14 having a generally rectangular shape when viewed from the front. Furthermore, a bracket 23 on which the light source units 21 of the high-beam lamp 20 are provided is, as seen from FIG. 1, integrally formed on one side of the lamp frame 14. A swivel drive mechanism 31 is provided on the bottom surface of the lamp frame 14, and an output shaft (not shown) that is rotated by a motor disposed in the swivel drive mechanism 31 is connected to the lower end of the lamp bracket 50. The motor of the swivel drive mechanism 31 can be driven in, for instance, accordance with the turning angle of the steering wheel of the vehicle. As seen from the above, the lamp bracket 50 is turned in the horizontal direction, so that the low-beam radiating direction formed by the light source units 40 is directed toward right or left.

As seen from FIG. 3, the front surface of the lamp bracket 50 of the low-beam lamp 30 are provided with (five) light source unit holding bases 51 that hold the light source units 40 and project forward. Each one of the light source unit holding bases 51 has a support plate 51*a* that extends horizontally, and a contact projected portion 51*b* projecting in a rectangular shape is formed on the top surface of the central portion of the support plate 5l*a*. Two projection walls 51*c* are formed to project upward from both side ends of the support plate 51*a*, and two grooves 51*d* are formed between the projection walls 51*c* and the contact projected portion 51*b*. Top walls 51*e* project further sideward from top ends of the projection walls 51*c*. A connecting projection 51*f* having a hollow cylindrical shape projects downward from the central portion in the right-left direction of the bottom surface of the support plate 51*a*, and a screw insertion hole 51*g* is formed in this connecting projection 51*f*. The bracket 50 is further provided with two positioning engagement openings 52, respectively, above the grooves 51*d*. In addition, a plurality of heat release fins 53 are formed on the rear surface of the lamp bracket 50, so that the lamp bracket 50 functions as a heat sink.

Figure 4:
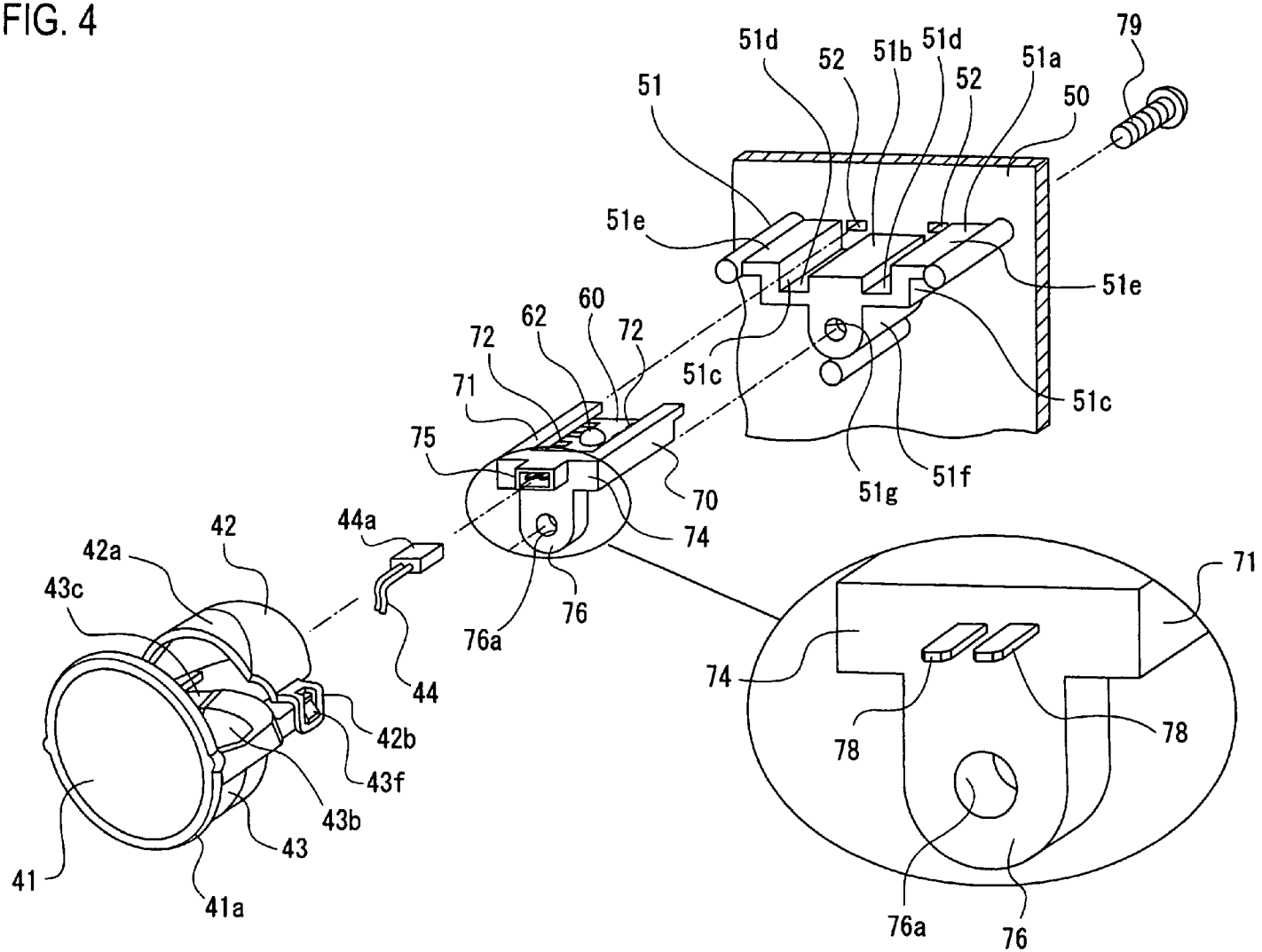
FIG. 4 is an exploded perspective view of the light source unit for the lamp of FIG. 1, showing also the attachment projection of the power supply socket in a circle.

As clearly shown in FIG. 4, the light source unit is, in addition to the projection lens 41, comprised of an LED module 60, a power supply socket 70, a reflector 42 which is for light distribution control, a shade 43 which is also for light distribution control, and a power supply harness 44.

Figure 5:
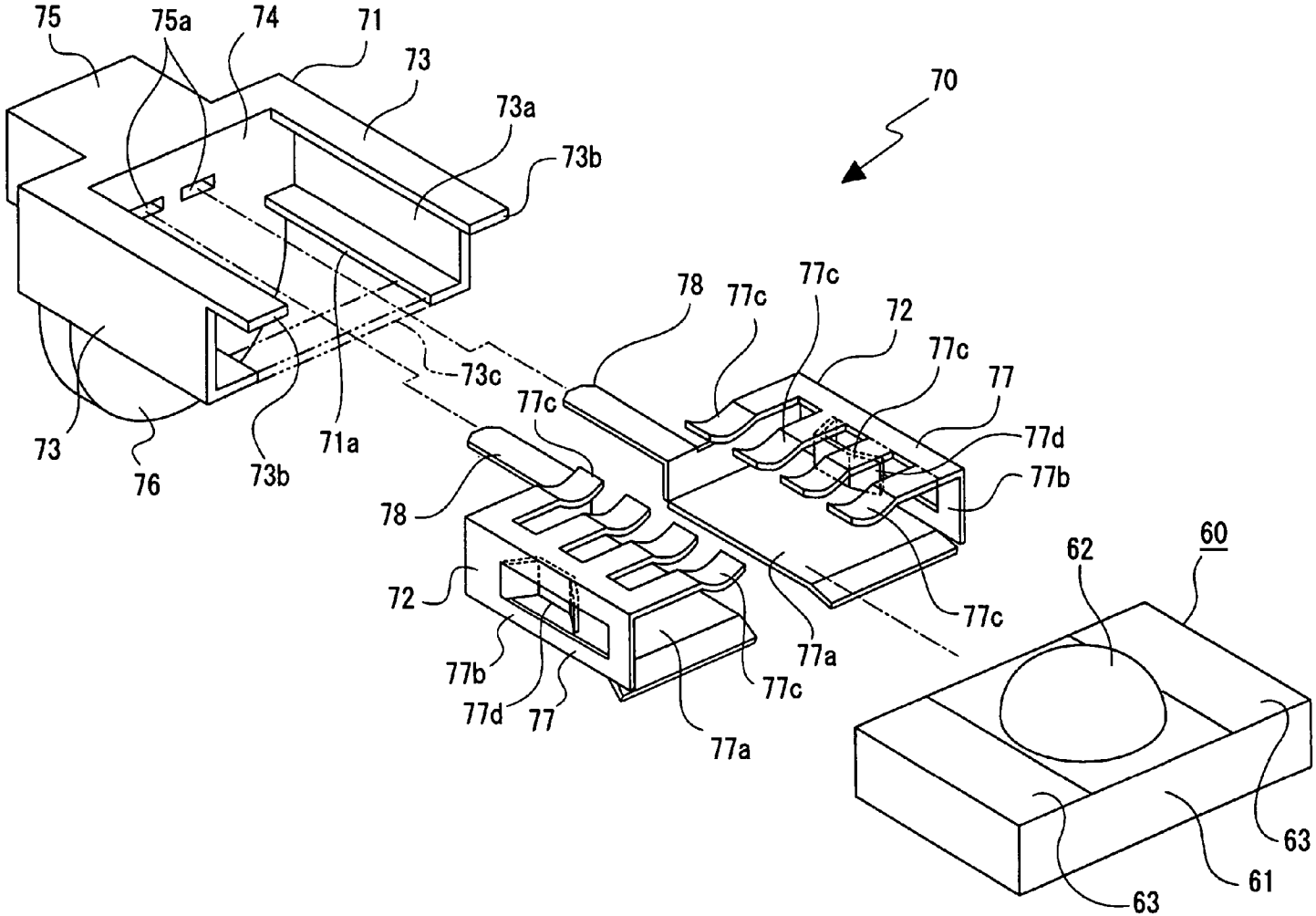
FIG. 5 is an exploded perspective view of the power supply socket as seen from the rear surface side.

The LED module 60, as seen from FIG. 5, includes an LED substrate 61 which is substantially a flat plate and has a rectangular shape or four-cornered shape, and an LED 62 is mounted on the top surface of the LED substrate 61 at substantially the center of the LED substrate, the top surface thus being an LED-mounted surface. A pair of current-conducting parts comprising positive and negative current-conducting parts 63 are formed on the top surfaces of the side edge portions of the LED substrate 61, so that the side edge portions sandwich the LED 62 or are located on both sides of the LED 62. The two current-conducting parts 63 are respectively connected to the positive and negative terminals (not shown) of the LED 62.

As seen from FIG. 5, the power supply socket 70 in this first embodiment is comprised of a base body 71 made from an insulating material and a pair of contact terminals 72 composed of positive and negative contact terminals. The positive and negative contact terminals 72 are held in the base body 71 and come into contact with the positive and negative current-conducting parts 63 of the LED module 60 when the LED module 60 is set in the power supply socket 70.

The base body 71 includes a pair of holding portions 73. The holding portions 73 are formed into a channel shape in which their open surfaces 73*a* face one another. In addition, positioning engagement pieces 73*b* are provided so as to project rearward from the upper ends on the rear end portions of the holding portions 73. A front end portion 74 of base body 71 is formed on the holding portions 73 so as to connect the front ends of the holding portions 73. With the above structure, the base body 71 has an opening 71*a* that opens to the top and toward the rear end and is surrounded by three sides comprising the two holding portions 73 and the single front end portion 74.

A connector casing 75 of a generally square tube shape projects forward from the central portion in the right-left direction of the front surface of the front end portion 74. In the back of the connector casing 75, insertion holes 75*a* are formed so that they extend from the front to the back and run through the front end portion 74 of the base body 71.

In addition, an attachment projection 76 is formed to project downward from the central portion in the right-left direction of the bottom of the front end portion 74 of the base body 71, and an attachment hole 76*a* is, as seen from FIG. 4, formed in the attachment piece 76.

The pair of or two contact terminals 72 of the power supply socket 70 are symmetric in shape, and each one of the contact terminals 72 is, as seen from FIG. 5, integrally formed with a contact portion 77 and a terminal piece 78 that projects forward from the contact portion 77.

The contact terminals 72 are made of a metal plate having spring elasticity and electrical conductivity. The contact portion 77 of each one of the contact terminals 72 has a generally C-shaped lateral cross-section, and a lower portion 77*a* and a side portion 77*b* thereof are formed in flat plane configurations. The contact piece 78 projects forward from the front end of the side portion 77*b*. The upper portion of the contact portion 77 is formed with a plurality of finger-like pieces (or elastic contact pieces) 77*c* (FIG. 5 shows four finger-like, elastic contact pieces 77*c*) which are longitudinally aligned and project from the upper end of the side portion 77*b* in the direction same as the lower portion 77*a*. Each one of the finger-like pieces 77*c* has a downwardly curved portion at the tip end. In addition, a central portion of the side portion 77*b* is formed with a pressing piece 77*d* projecting inward.

The two contact terminals 72, each formed as described above, are separately or respectively inserted in the two holding portions 73 of the base body 71 such that that the tip ends of the respective finger-like pieces 77*c* of the contact terminals 72 face each another; as a result, the terminal pieces 78 are inserted in the insertion holes 75*a* formed in the front end portion 74 of the base boy 71 so as to be positioned within the connector casing 75 of the base boy 71, and the contact portions 77 of the contact terminals 72 are positioned within the holding portions 73 of the base boy 71.

After the two contact terminals 72 are set in the base body 71 as described above, the LED module 60 is inserted from behind into the holding portions 73 of the base body 71 of the power supply socket 70 with the surface mounted with the LED 62 is facing upward and with the two current-conducting parts 63 positioned on the right and left thereof. When the LED substrate 61 abuts the rear surface of the front end portion 74 of the base body 71 of the power supply socket 70, the LED module side edge portions formed with the current-conducting parts 63 are completely positioned within the holding portions 73 of (the base body 71 of) the power supply socket 70, the bottom surfaces of the side edge portions of the LED substrate 61 are positioned on the lower portions 77*a* of the contact terminals 72, and the current-conducting parts 63 formed on the top surfaces of the side edge portions of the LED module are in elastic contact with the finger-like pieces 77*c* of the contact terminals 72.

As a result, the LED module 60 is held by the holding portions 73 of the power supply socket 70, and a connection between the LED 62 of the LED module 60 and the contact terminals 72 (particularly the finger-like pieces 77*c*) of the power supply socket 70 is established. Furthermore, the pressing pieces 77*d* formed on the side portions 77*b* of the contact terminals 72 are pressed against the side end surfaces of the LED substrate 62, so that looseness of the LED module 60 within the power supply socket 70 is prevented, and the LED module 60 is assuredly held in the power supply socket 70.

In addition, when the the LED module 60 is installed in the base body 71 of the power supply socket 70, since base body 71 has the opening 71*a* that opens to the top and toward the rear end, the top surface of the LED-mounted surface of the LED substrate is exposed, so that heat generated by light emitted by the LED can be easily released through the opening, and excess amount of heat in the LED module 60 and the power supply socket 70 is prevented.

As described above, the power supply socket 70, which contains the LED module 60 inside and thus forms the light source unit 40, is held by the light source unit holding base 51 of the lamp bracket 50. More specifically, the holding portions 73 of the power supply socket 70 of the light source units 40 is positioned on the support plate 51*a* of the light source unit holding base 51, and the positioning engagement pieces 73*b* on the rear ends of the holding portions 73 are engaged with the positioning engagement openings 52 formed above the light source unit holding base 51 of the lamp bracket 50. In this state, the lower end portions of the holding portions 73 are engaged with the grooves 51*d* of the light source unit holding base 51; and the contact projected portion 51*b*, which is between the two grooves 51*d*, is positioned in the opening 71*a*, which is between the two holding portions 73, and as a result, the contact projected portion 51*b* is brought into an abutment with the lower surface of the LED substrate 61 of the LED module 60.

Figure 6:
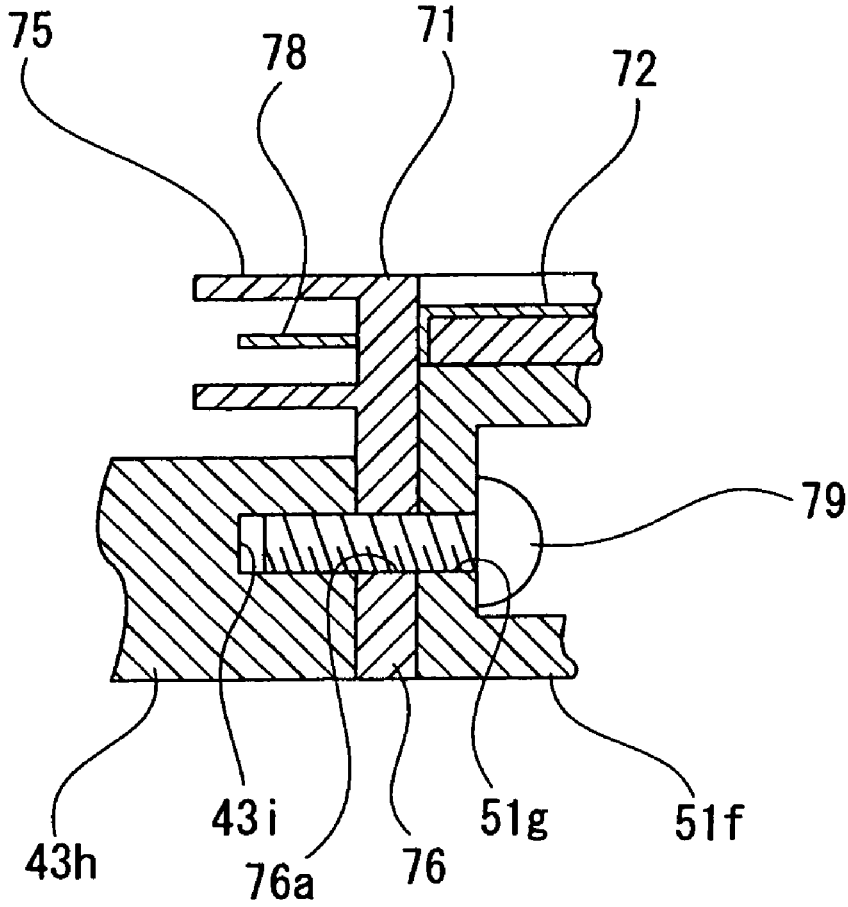
FIG. 6 is a cross-sectional view showing the portion in which the power supply socket is attached to the support base of the lamp bracket.

As shown clearly in FIG. 6, the attachment projection 76 of the base body 71 of the power supply socket 70 abuts the front end face of the connecting projection 51*f* of the light source unit holding base 51, and the attachment hole 76*a* of the attachment projection 76 is aligned with the screw insertion hole 51*g* of the connecting projection 51*f*. Then, an attachment screw 79 is inserted into the screw insertion hole 51*g* of the light source unit holding base 51 from behind and is screwed into the attachment hole 76*a* of the base body 71 of the power supply socket 70, and moreover, the attachment screw 79 is screwed together with a screw hole (described later) of the shade 43. As a result, the attachment projection 76 is held between the shade 43 and the connecting projection 51*f* of the light source unit holding base 51, and the power supply socket 70 is thus provided on the light source unit holding base 51 of the lamp bracket 50.

A harness connector 44*a* connected to the tip end of the power supply harness 44 described above is fitted in the connector casing 75 (see FIG. 4) of the power supply socket 70, so that the power supply harness 44 is connected to the contact terminals 72 of the power supply socket 70. As result, the LED 62 receives electric power via the contact terminals 72 and power supply harness 44.

The connector casing 75 of the power supply socket 70 can be eliminated as shown in the enlarged illustration in a circle in FIG. 4. In this structure, thought the terminal pieces 78 of the contact terminals 72 are exposed, this does not cause any problem because the connection is electrical.

Figure 7:
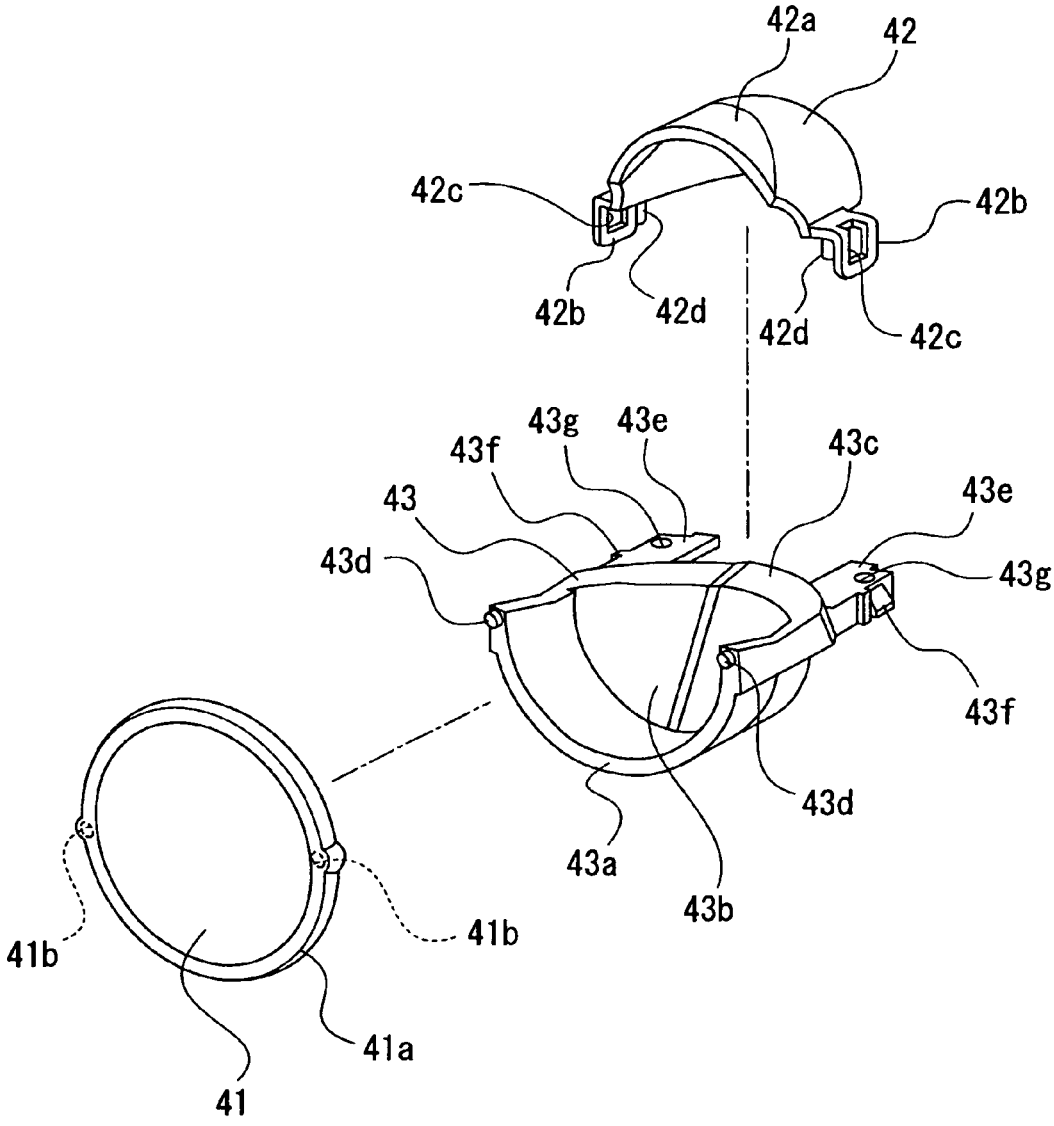
FIG. 7 is a perspective view of the projection lens and the reflector seen, together with the shade, from the front surface side.
Figure 8:
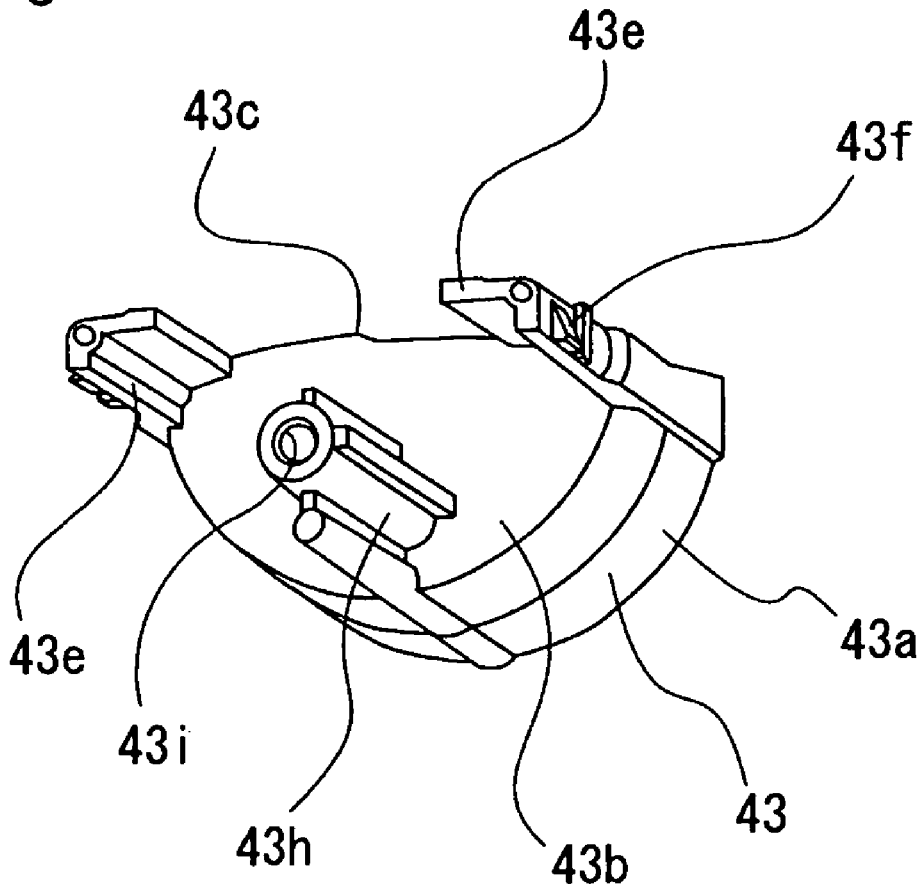
FIG. 8 is a rear perspective view of the shade.

As seen from FIGS. 7 and 8, the shade 43 has a light-shielding edge for forming a cut-off line. More specifically, the shade 43 is comprised of, as seen from FIG. 7, a semi-cylindrical portion 43*a* that has a shape in which the upper half of an empty cylinder is cut away with only the lower half left, and a wall portion 43*b* is formed in the semi-cylindrical portion 43*a* so that it closes the rear portion of the semi-cylindrical portion 43*a* and so that it limits the upper edge of a low-beam light distribution pattern.

Positioning projections 43*d* are formed on the front surfaces of the upper ends of both side portions of the semi-cylindrical portion 43*a*, and support portions 43*e* are formed to project rearward from both side portions of the upper end portion of the rear surface of the wall portion 43*b*. The support portions 43*e* are respectively formed with engagement tabs 43*f* projecting from the outer side surfaces of the support portions 43*e*, and engagement holes 43*g* are formed in the top surfaces of the support portions 43*e*. As seen from FIG. 8, an attachment boss 43*h* projects rearward from the lower end of the rear surface of the wall portion 43*b* of the shade 43, and a screw hole 43*i* is formed in the attachment boss 43*h* so as to have the opening on the rear side of the attachment boss 43*h*. The attachment screw 79, which is, as described above, inserted from behind into the screw insertion hole 51*g* of the light source unit holding base 51 of the lamp bracket 50 and into the attachment hole 76*a* of the power supply socket 70, is screwed into the screw hole 43*i* of the attachment boss 43*h* of the shade 43.

The reflector 42 is provided on the shade 43 so as to cover the LED 62 of the LED module 60, which is held by the power supply socket 70, from above and behind. The reflector 42 includes a reflective surface portion 42*a*, which has on its inner surface a reflective surface having a light-condensing property, e.g., a reflective surface made of a substantially upper half of a curved surface such as an ellipsoidal surface, a hyperboloidal surface, or a parabolic surface. The reflector 42 further includes connecting elements 42*b* that are in a substantially inverted L shape when seen from the front and are formed on the front ends on both sides of the reflective surface portion 42*a*. Engagement holes 42*c* are formed in the vertical wall portions of the connecting elements 42*b*, and fitting pins 42*d* that project downward are formed on the horizontal wall portions of the connecting elements 42*b*.

The fitting pins 42*d* of the reflector 42 are press-fitted into the engagement holes 43*g* formed on the top surfaces of the support portions 43*e* of the shade 43, and the engagement holes 42*c* of the reflector 42 are engaged with the engagement tabs 43*f* formed on the outer side surfaces of the support portions 43*e* of the shade 43, so that the reflector 42 is held on the shade 43. The reflective surface portion 42*a* of the reflector 42 thus installed covers the LED 62 of the LED module 60 from above and behind, and light emitted from the LED 62 is as a result reflected by the reflective surface of the reflective surface portion 42*a* and condensed in the vicinity of the light-blocking edge 43*c* of the shade 43.

The projection lens 41 is secured in a circular lens-holding frame 41*a* that has, on its right and left side portions, fitting holes 41*b* that open in the rear surface of the lens-holding frame 41*a*. The engagement holes 41*b* of the lens-holding frame 41*a* are fitted on the positioning projections 43*d* of the front end of the shade 43. As a result, the projection lens 41 is positionally fixed and attached to the shade 43, and the focal point of the projection lens 41 is set to be positioned in the vicinity of the light-blocking edge 43*c* of the shade 43.

The light source unit 40 is configured as described above.

The contact terminals of the power supply socket 70 of the light source unit 40 can take other configurations than that described above, and such modifications will be described below.

Figure 9:
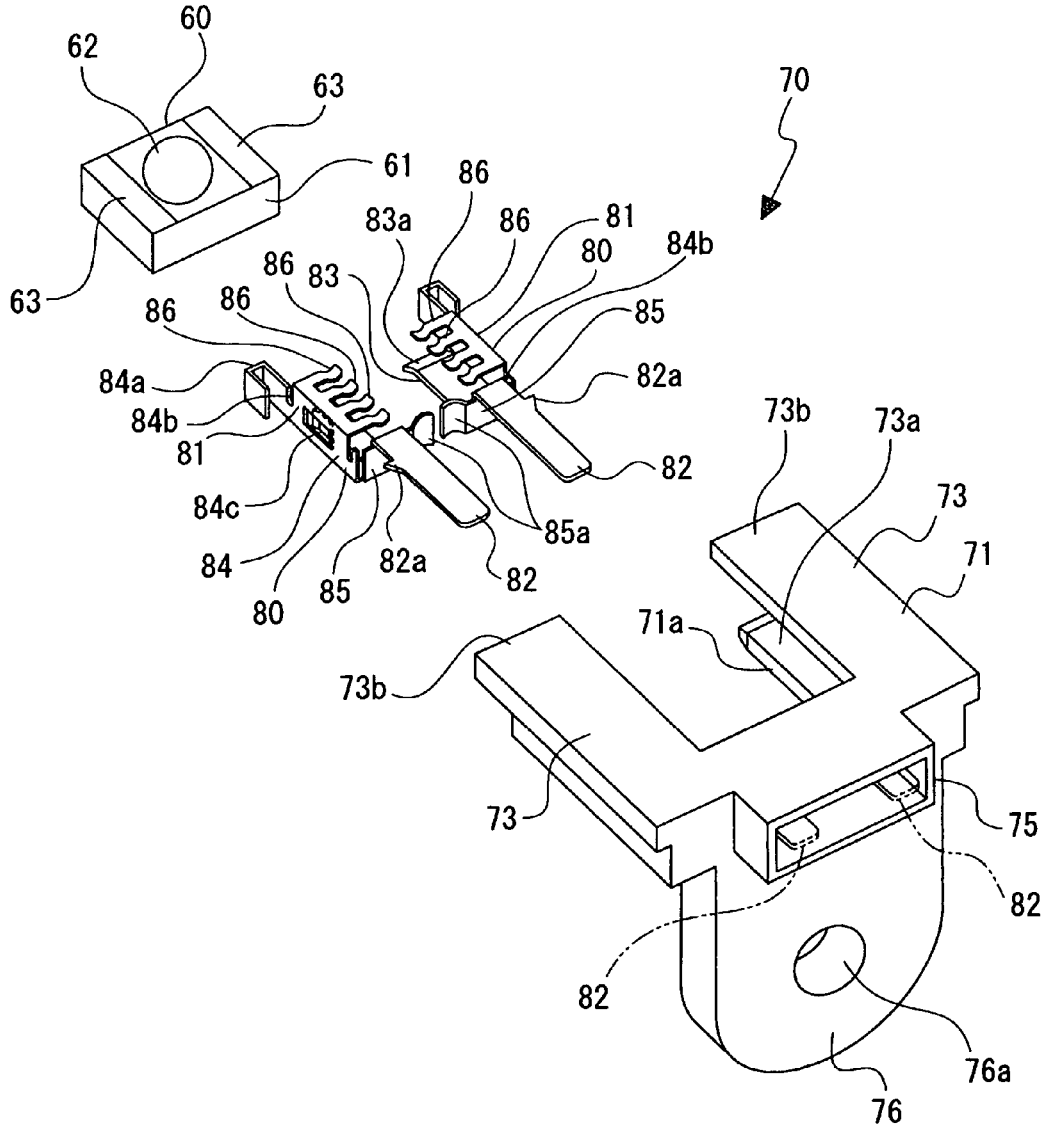
FIG. 9 is a perspective view of a modification of the contact terminals.

FIG. 9 shows the first modification of the pair of contact terminals.

Each one of the contact terminals 80 composed of positive and negative contact terminals in FIG. 9 includes a contact portion 81 that has a terminal piece 82 projecting forward from the front end of the contact portion 81. The contact portion 81 of the contact terminal 80 has a generally C-shaped lateral cross-section. The lower portion 83 of the contact portion 81 is generally flat, and the rear end portion 83*a* thereof is bent diagonally downward. The front surface portion 85 that stands upright is formed on the front end of the lower portion 83 of the contact portion 81. A stopper piece 85*a* is formed slightly biased or curved rearward on the inner end of the front surface portion 85. The terminal piece 82 projects forward from the upper edge of the front surface portion 85. The side portion 84 of the contact terminal 80 is formed with a rear end portion that has an engagement portion 84*a*which projects outward and has a C-shape opening forward. A notch 84*b* is formed in the upper edge of front end of the engagement portion 84*a*. Furthermore, a pressing portion 84*c* is formed at substantially the central portion in the longitudinal direction of the side portion 84 of the contact terminal 80, so that the pressing portion 84*c* projects inward; in other words, the pressing portion 84*c* projects in the direction same as the projecting direction of the lower portion 83 that projects from the side portion 84. The upper portion of the contact portion 81 is formed with a plurality of finger-like pieces (elastic contact pieces) 86 which are longitudinally aligned and project from the upper end of the side portion 84 in the same direction as the lower portion 83. Each of the finger-like pieces 86 has a somewhat downwardly curved portion at the tip end. A holding tab 82*a* that projects outward is formed on the base end of the outer side edge of the terminal piece 82.

The above-described contact terminals 80 are separately inserted into the respective holding portions 73 of the base body 71 such that the tip ends of the finger-like pieces 86 of the two contact terminals 80 face one another, and the terminal pieces 82 of contact terminals 80 are inserted into the insertion holes 75*a* (see the corresponding insertion holes 75*a* in FIG. 5) formed in the front end portion 74 (see the corresponding front end portion 74 in FIG. 5) so as to be positioned (as shown by imaginary lines in FIG. 9) inside the connector casing 75, so that the contact portions 81 of the contact terminals 80 are positioned in the holding portions 73 of the base body 71. The engagement portions 84*a* formed on the rear ends of the side portions 84 are engaged with and surround the rear end portions of the holding portions 73, so that the insertion depth of the contact terminals 80 into the holding portions 73 is determined. In addition, the holding tabs 82*a* of the terminal pieces 82 of the contact terminals 80 press against the inner wall surfaces of the insertion holes 75*a* of the base body 71 so as to prevent the separation of the contact terminals 80 from the base body 71.

In the structure of FIG. 9 as well, the LED module 60 is inserted in the holding portions 73 of the base body 71 of the power supply socket 70, and the side edge portions formed with the current-conducting parts 63 on the LED base plate 61 are held in a sandwiched fashion by the finger-like pieces 86 and the lower portions 83 of the two contact terminals 80, and in addition the side end surfaces of the LED base plate 61 are pressed by the pressing portions 84*c* of the contact terminals 80, so that looseness of the LED module 60 with respect to the power supply socket 70 is prevented.

Though the pressing portions 84*c* are formed on both of the two contact terminals 80 in the above description, the pressing portion 84*c* can be formed in only one contact terminal 80. In addition, the insertion depth of the LED module 60 into the holding portions 73 of the base body 71 can be determined by the contact of the front end of the LED base plate 61 with the stopper pieces 85*a* of the contact terminals 80.

Figure 10:
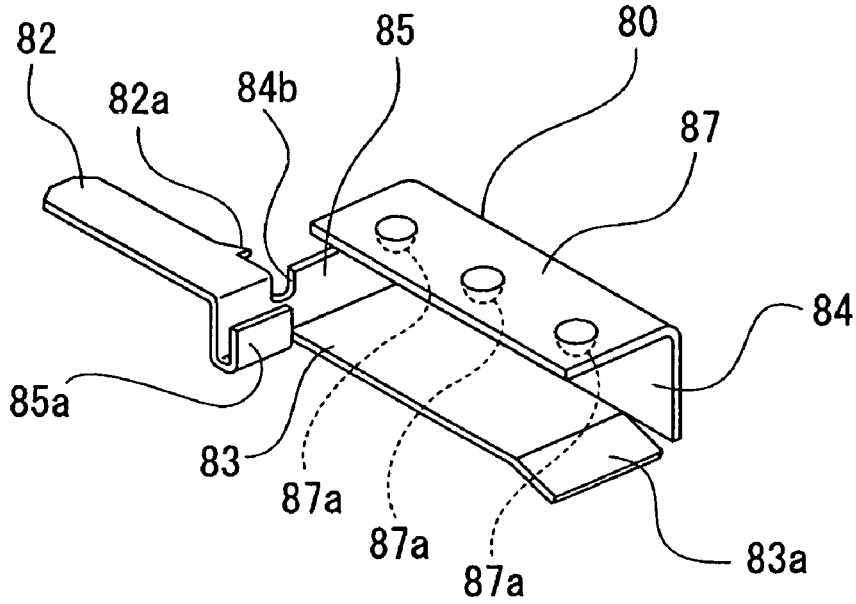
FIG. 10 is a perspective view of the main portion of a modification of the upper portion of the contact terminal of FIG. 9.

The upper portions of the contact terminals 80 described above and shown in FIG. 9 can be modified as shown in FIG. 10.

The upper portions of the contact terminals 80 of FIG. 9 are formed with a plurality of finger-like pieces 86; however, in each of the contact terminals 80 shown in FIG. 10, the upper portion 87 is formed as a flat plate and is formed with a plurality of (three in FIG. 10) contact projections 87*a* which are longitudinally aligned and project downward in a hemispherical shape, so that the the upper portion 87 makes an elastic contact piece.

Accordingly, as can be seen from FIG. 9, when the LED module 60 is inserted in the holding portions 73 of the base body 71 of the power supply socket, the contact projections 87*a* formed on the unersurfaces of the upper portions (elastic contact pieces) 87 of the contact terminals 80 come into contact with the current-conducting parts 63 of the LED module 60.

A modification of the pressing portions 84*c* of the contact terminals 80 of FIG. 9 will be described with reference to FIG. 11.

In the structure of FIG. 9, the pressing portions 84*c* that press the side ends of the LED base plate 61 are formed on the side portions 84 of the contact terminals 80. In the modification of FIG. 11, the pressing portion is formed on the lower portions 88 of the contact terminals 80.

More specifically, notches 88*a* extending in the width direction of the contact terminal 80 are formed at positions along both front and rear ends of the flat lower portion 88 of the contact terminal 80. A projecting end of a portion that is between the notches 88*a* is bended upward, so that it acts as a pressing piece 88*b*. The rear end portion of the pressing piece 88*b* is diagonally bent toward the side portion 84 so that the bent rear end portion acts as a lead-in guide 88*c*.

Figure 11:
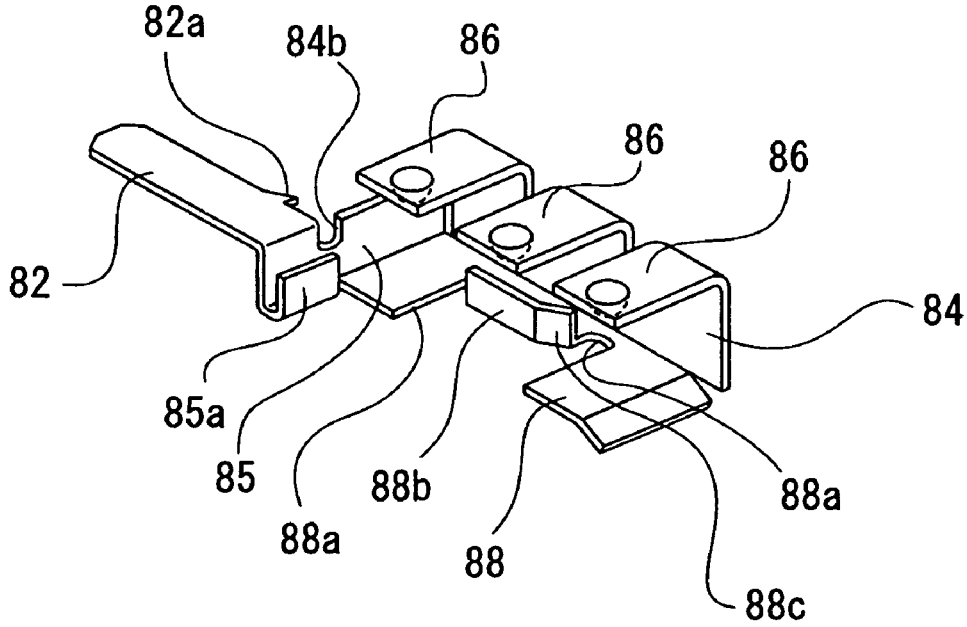
FIG. 11 is a perspective view of the main portion of a modification of the pressing portion of the contact terminal of FIG. 9.

With the structure described above, as can be seen from FIG. 9, when the LED module 60 is inserted in the holding portions 73 of the base body 71 of the power supply socket 70, the pressing piecees 88*b* of of the contact terminals 80 of FIG. 11 are pressed against the side ends of the LED base plate 61, so that looseness of the LED module 60 is prevented. In the structure of FIG. 11, when inserting the LED module 60 into the holding portions 73, the lead-in guides 88*c* formed on the rear end portions of the pressing pieces 88*b* guide the corner of the front end of the LED base plate 61.

Figure 12:
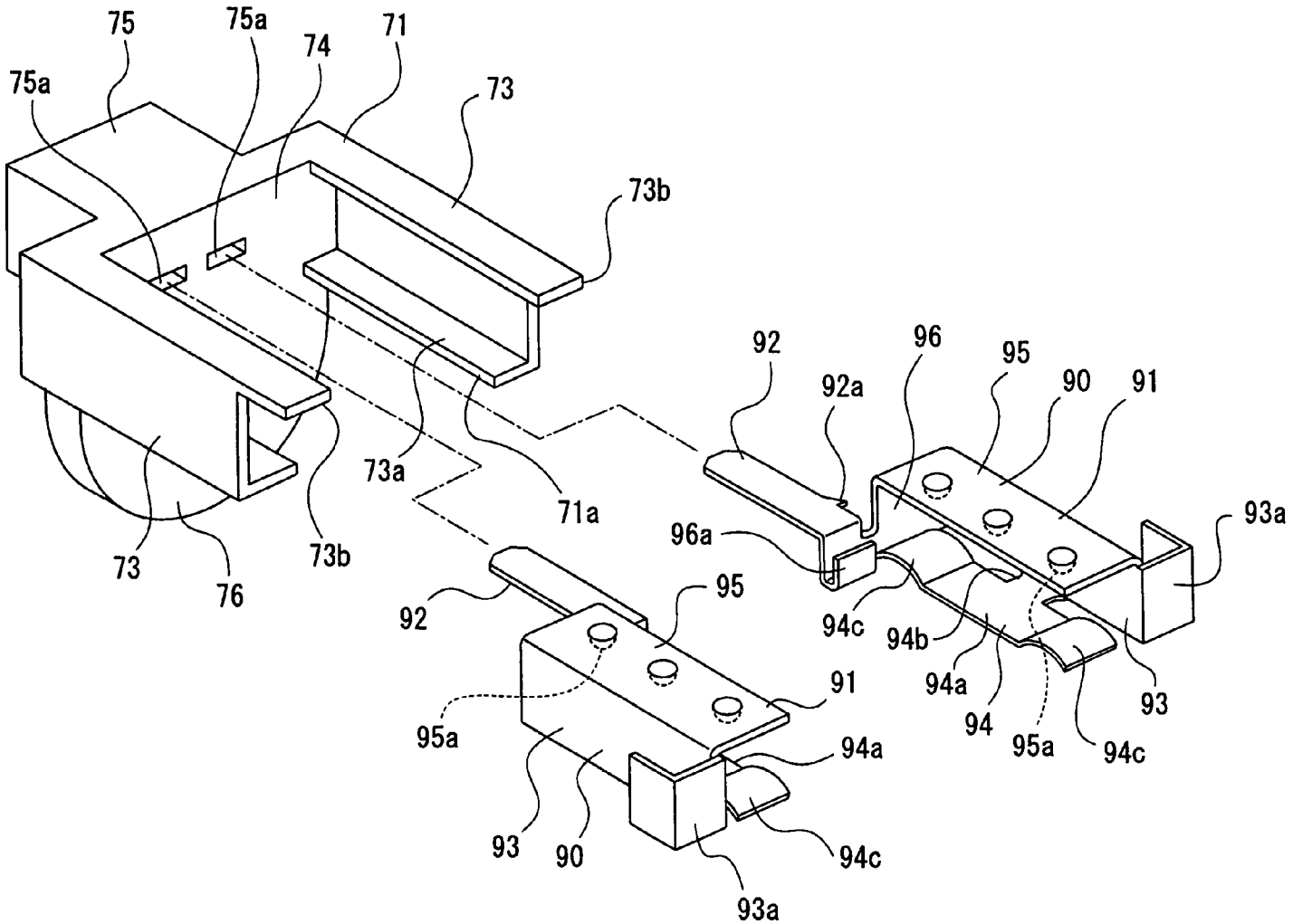
FIG. 12 is a perspective view of another modification of the contact terminals.
Figure 13:
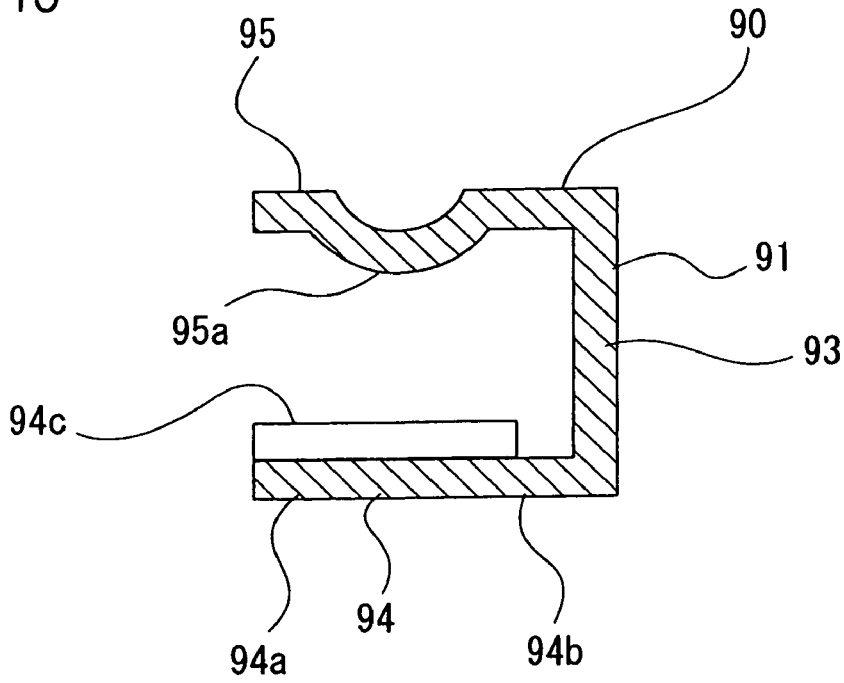
FIG. 13 is a horizontal cross-sectional view of the main portion of the of the contact terminals of FIG. 12.

FIGS. 12 and 13 show another modification of the pair of contact terminals.

Each one of the contact terminals 90 includes a contact portion 91 and a terminal piece 92 that projects forward from the front end of the contact portion 91. The contact portion 91 has a generally C-shaped lateral cross-section, and its side portion 93 has, at its rear end, a C-shaped engagement portion 93*a* that projects outward and opens forward. The front surface portion 96 of the contact terminal 90 is provided at the front end of the side portion 93, and it projects in the same direction as the projecting direction of the lower portion 94 and upper portion 95 of the contact terminal 90. The terminal piece 92 projects forward from the upper end of the front surface portion 96. In addition, an elastic stopper 96*a* that is bent backward and then upward extended from the lower edge of the inner end of the front surface portion 96.

The lower portion 94 of the contact terminal 90 is comprised of a main part 94*a*, which extends in the longitudinal direction of the contact terminal 90, and a connecting portion 94*b*, which connects the main part 94*a* to the lower edge of the side portion 93 at the central portion in the longitudinal direction of the main part 94*a*. Both front and rear end portions 94*c* of the main part 94*a* are curved upward so that both end portions 94*c* of the main part 94*a* have considerable elasticity. The upper portion 95 of the contact terminal 90 is flat and is formed with a plurality of (three in FIG. 12) contact projections 95*a* which are longitudinally aligned and project downward in a hemispherical shape, the upper portion 95 thus making an elastic contact piece. A holding tab 92*a* that projects outward is formed on the base end of the outer side edge of the terminal piece 92.

In the contact terminals 90 as described above, the engagement portions 93*a* formed on the rear ends of the side portions 93 and the holding tabs 92*a* of the terminal pieces 92 function in the same manner as the engagement portions 84*a* and the holding tabs 82*a* of the contact terminal 80 shown in FIG. 9, respectively. Accordingly, when the LED module 60 (see FIG. 9) is inserted in the holding portions 73 of the base body 71 of the power supply socket 70, the curved portions 94*c* on front and rear ends of the lower portions 94 of the contact terminals 90 elastically press upward against the lower surfaces of the LED substrate side edge portions formed with the current-conducting parts 63. Accordingly, the current-conducting parts 63 of the LED substrate are pressed into contact with the contact projections 95*a* of the upper portions 95 of the contact terminals 90. In addition, insertion of the LED module 60 into the holding portions 73 is stopped when the front end of the LED substrate 61 comes in contact with the elastic stopper 96*a* of the contact terminals 90.

Figure 14:
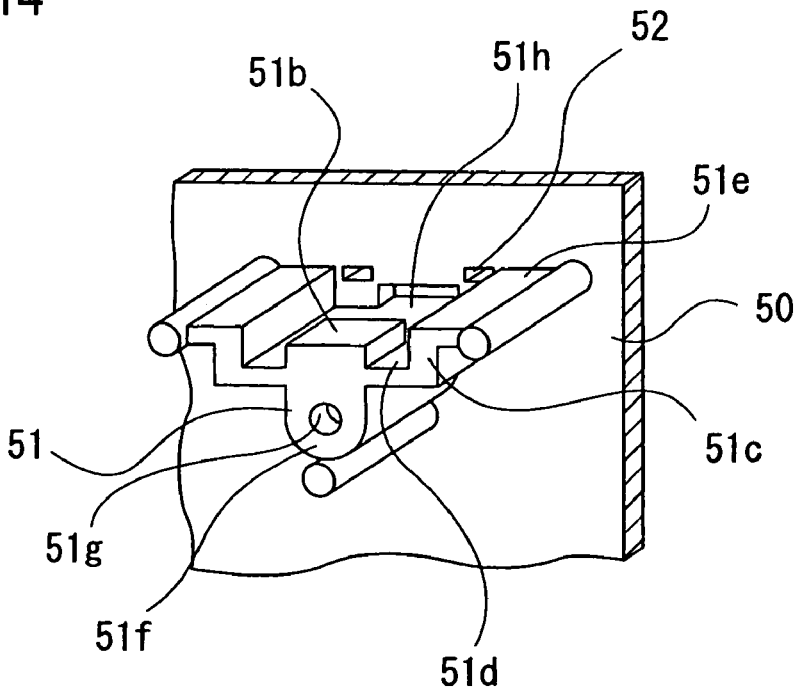
FIG. 14 is a perspective view of a modification of the light source unit holding base provided in the lamp bracket.

In the base body 71 of the power supply socket 70 described above and shown in FIG. 12, the holding portions 73 and the front end portion 74 form a letter C-shape that opens rearward when viewed from above. Accordingly, the base body 71 has a C-shaped opening 71*a* that opens rearward; and as shown by two-dotted broken lines in FIG. 5, a connecting bar 73*c* that connects two opposing holding portions 73 at the rear ends thereof can be integrally formed so that the opening 71*a* opens only upward and downward. The connecting bar 73*c* increases the strength of the base body 71. When the connecting bar 73*c* is provided as shown in FIG. 5, a groove 51*h* must be formed in the light source unit holding base 51 as shown in FIG. 14 so that it connects the grooves 51*d* on both sides of the rear end of the contact projected portion 51*b* on the light source unit holding base 51 that is formed on the lamp bracket 50. The longitudinal width of the groove 51*h* is equal to the length which is the projection length of the positioning engagement piece 73*b* added to the longitudinal length of the connecting bar 73*c* of the base body 71 of the power supply socket.

When the power supply socket 70 structured as described above is to be attached to the light source unit holding base 51, the power supply socket 70 is first brought toward the support plate 51*a* of the light source unit holding base 51 from above. Then, the connecting bar 73*c* (see FIG. 5) of the base body 71 of the power supply socket 70 is inserted into the front side of the groove 51*h* (see FIG. 14) of the light source unit holding base 51, so that the contact projected portion 51*b* can be inserted into the opening 71*a* of the base body 71. Thereafter, the power supply socket 70 is moved backwards or toward the lamp bracket 50, so that the terminal pieces 92 of the contact terminals 90 are engaged with the positioning holes 52 of the lamp bracket 50. The attachment screw 79 is subsequently inserted through the screw insertion hole 51*g* of the light source unit holding base 51 and then into the attachment hole 76*a* of the base body 71 of the power supply socket 70 in that order. Following this, the attachment screw 79 is screwed into the screw hole 43*i* of the shade 43 (see FIG. 6), so that the shade 43 and the power supply socket 70 are attached to the light source unit holding base 51.

Figure 15:
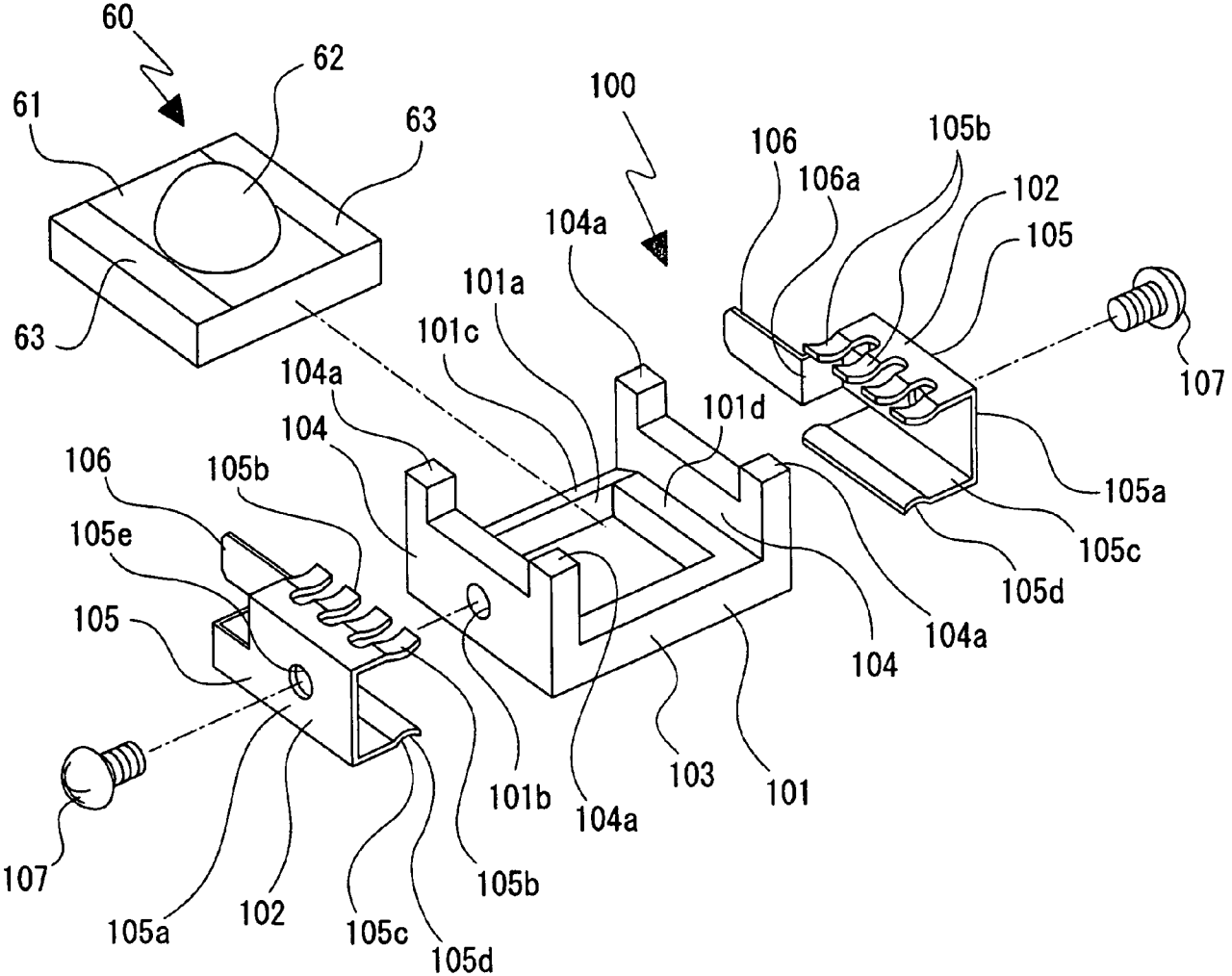
FIG. 15 is an exploded perspective view of the main portion of a modification of the power supply socket.
Figure 16:
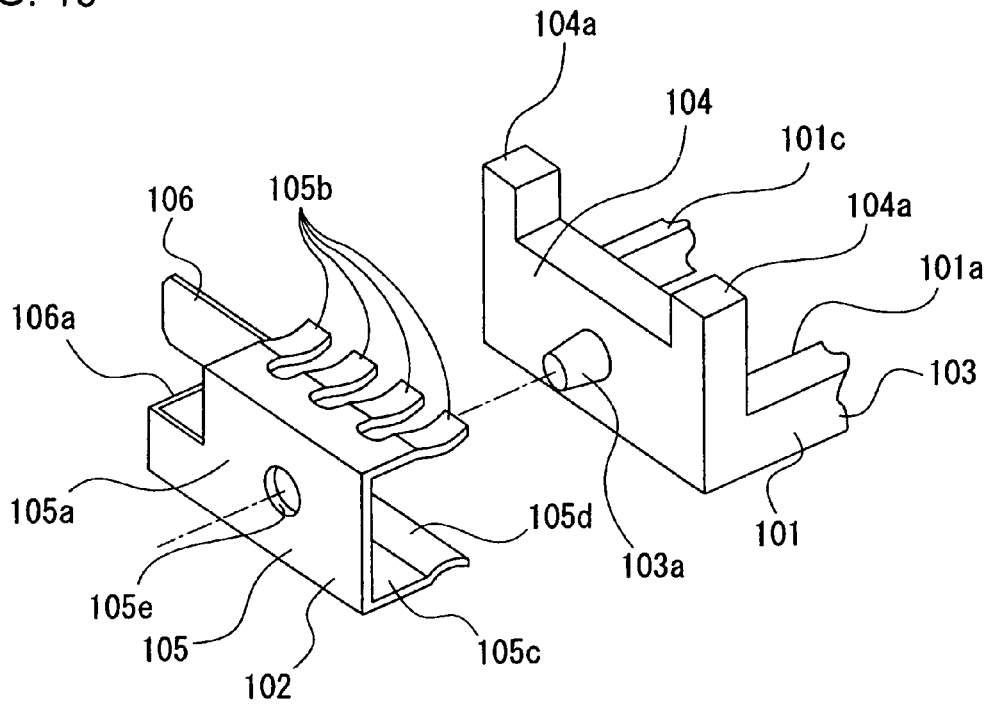
FIG. 16 is an exploded perspective view of the main portion of a modification of the contact terminal shown in FIG. 15.
Figure 17:
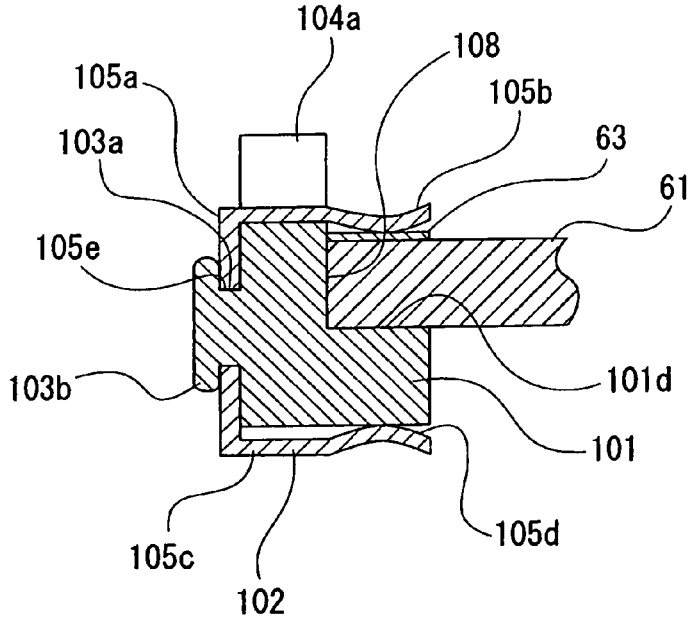
FIG. 17 is a cross-sectional view of the main portion of a state in which the contact terminal of FIG. 16 is fixed to the base body.

FIGS. 15 to 17 show a modification of the power supply socket.

The power supply socket 100 is comprised of, as seen from FIG. 15, a base body 101, which is made from an insulating material, and a pair of contact terminals 102, which have spring elasticity and electrical conductivity.

The main section 103 of the base body 101 is configured as a flat plane and has a large rectangular opening 101*a*, and a pair of wall portions 104 that project upward are formed along both right and left side edges of the main section 103. Positioning projections 104*a* are formed to project further upward from both front and rear end portions of the wall portions 104. The main section 103 is further formed with screw holes 101*b* in both wall portions 104 (though only one is shown in FIG. 15) so that the screw holes 101*b* open to both side ends. In addition, the upper surface of the rear end portion of the main section 103 is formed with an inclined surface 101*c* that inclines rearward of the base body 101, and the upper surfaces of portions adjacent to the inner sides of the wall portions 104 are formed as receiving surfaces 101*d*.

On the other hands, each of the contact terminals 102 is comprised integrally of a contact support portion 105 having a generally C-shaped lateral cross-section and a terminal piece 106 projecting rearward from the rear end of the contact support portion 105. The contact support portion 105 is formed integrally of a side surface portion 105*a*, whose both surfaces face to the right and left and are longitudinally long, and an upper portion and a lower portion 105*c*, which project in the same direction from the upper and lower end edges of the side surface portion 105*a*. The upper portion of the contact support portion 105 is formed with a plurality of finger-like pieces 105*b* that are longitudinally aligned. Each of the finger-like pieces 105*b* is curved such that its intermediate portion projects downward, so that the finger-like pieces 105*b* make elastic contact pieces. In addition, the lower portion 105*c* of the contact support portion 105 is shaped as a flat plate, and a projecting end thereof is curved so as to project upward, thus having an elastic contact portion 105*d*, which increases the bending strength of the contact terminal 102. A screw insertion hole 105*e* is formed in the central portion of the side surface portion 105*a* of the contact support portion 105. The terminal piece 106 of the contact terminal 102 has a base end portion that is bent into an L shape, and the tip end of the L-shaped bent portion 106*a* is continuous to the rear end of the side surface portion 105*a* of the contact support portion 105.

The pair of contact terminals 102 formed as described above are attached to the base body 101 from both sides. So as to assure that the upper portion, i.e., the base portions of the finger-like pieces (elastic contact piece) 105*b* of each one of the contact terminals 102 contact the upper end surface of the wall portion 104 between two positioning projections 104*a*, and so as to assure that the lower portion 105*c* of each contact terminal 102 contacts the lower surface of the main section 103 of the base body 101, the contact support portion 105 of the contact terminal 102 is brought to sandwich the side portion of the main section 103 of the base body 101 from above and below, and the inner side surface portion 105*a* is bought to contact the outer side end surface of the main section 103 and the outer side surface of the wall portion 104, and further a screw 107 is inserted from the outer side into the screw insertion hole 105*e* of the contact terminal 102 and is then screwed into the screw hole 101*b* of the main section 103 of the base body 101. As a result, the contact terminals 102 are fixed to the side portions of the base body 101, and the finger-like pieces 105*b* project from the upper ends of the wall portions 104 toward the central area of the main section 103 of the base body 101. As a result, as seen from FIG. 17, a generally C-shaped holding section 108 is defined by the finger-like pieces 105*b*, the wall portion 104, and the receiving surface 101*d* of the base body 101.

With the arrangement described above, the LED module 60 is installed in the power supply socket 100 that is comprised of the base body 101 and the pair of contact terminals 102. More specifically, the side edge portions of the LED substrate 61, in a state that the LED 62 is positioned on its top side, are inserted from behind into the holding section 108 of the power supply socket 100. When this insertion is being made, the inclined surface 101*c* formed on the rear end of the base body 101 assists the LED substrate 61 to be slid into the holding sections 108. When the LED substrate 61 is completely inserted in the holding sections 108, the finger-like pieces 105*b* of the contact terminals 102 elastically contact the current-conducting parts 63 formed on the upper surfaces of the side edge portions of the LED substrate 61. An electrical connection is thus established between the contact terminals 102 and the LED 62. Since the elastic force of the finger-like pieces 105*b* presses the side edge portions of the LED substrate 61 against the receiving surfaces 101*d* of the base body 101, the LED module 60 is assuredly held in the power supply socket 100.

The harness connector 44*a* (see FIG. 4) connected to the tip of the power supply harness 44 is connected to the terminal pieces 106 of the contact terminals 102, and the LED 62 is thus connected to a lighting circuit (not shown).

FIGS. 16 and 17 show a modification of a structure for attaching the contact terminals 102 to the base body 101.

In the structure of FIGS. 16 and 17, the side end surface of the main section 103 of the base body 101 is not formed with a screw hole; and instead, a caulking boss 103*a* is provided to project therefrom, and the caulking boss 103*a* is inserted through the screw insertion hole 105*e* of the contact terminal 102. As shown in FIG. 17, a portion of the caulking boss 103*a* protruding from the screw insertion hole 105*e* is subsequently caulked to form an anti-loosening head portion 103*b*, so that the contact terminal 102 is secured to the base body 101. According to this modification, the screws 107 are not required, and it is possible to reduce the parts cost and the parts management becomes easier.

Figure 18:
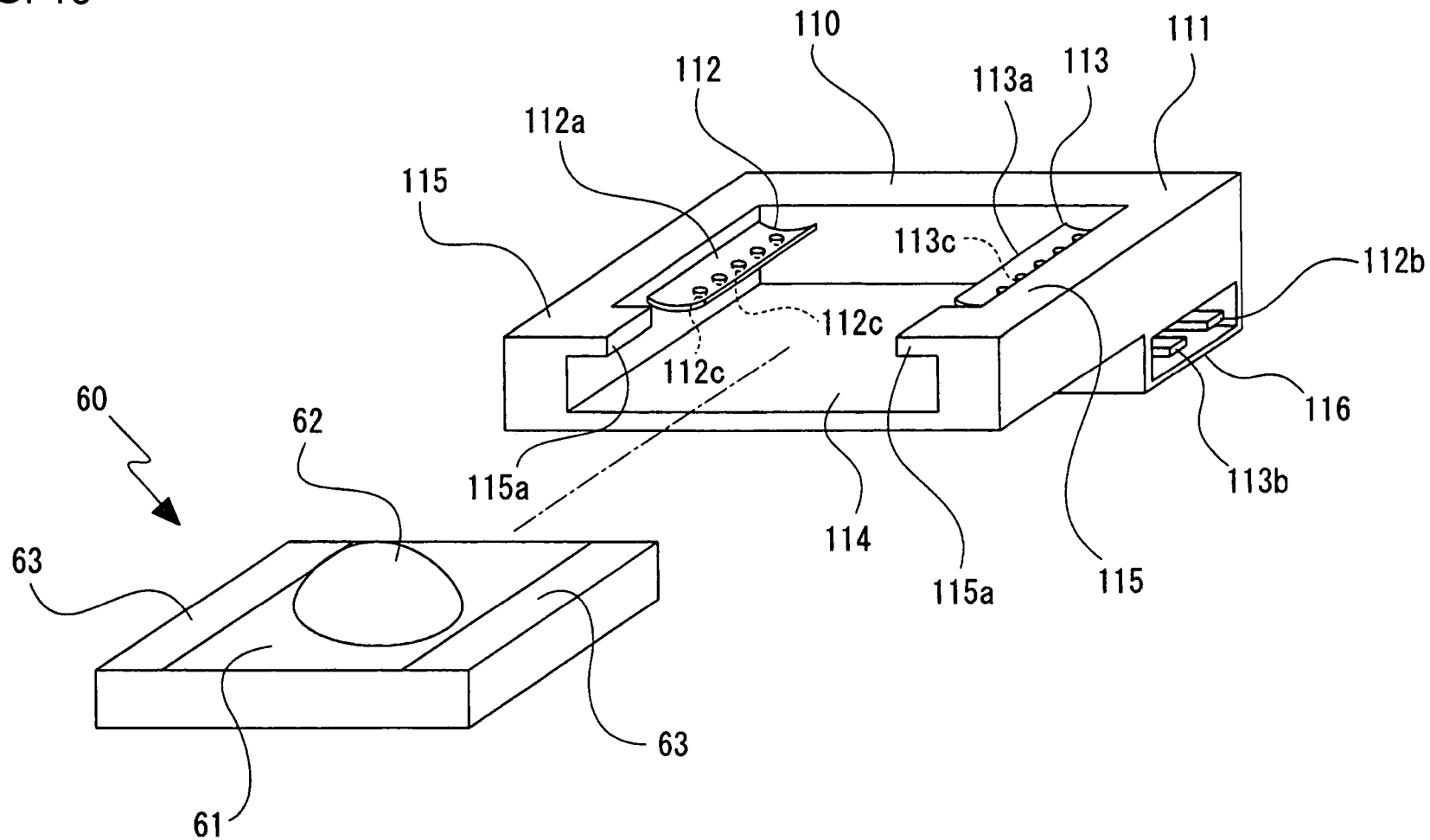
FIG. 18 is a perspective view of a still another modification of the power supply socket of the present invention.

FIG. 18 shows a still another modification of the power supply socket.

The power supply socket 110 is comprised of a base body 111, which is made from an insulating material, and a pair of contact terminals 112 and 113, which are made from a metallic material and having spring elasticity and electrical conductivity.

The base body 111 is formed with a peripheral wall that is formed on three peripheral edge portions of a substantially square flat bottom portion 114, excluding the rear edge portion, so as to make a C-shape when viewed from above. Laterally opposing peripheral walls 115 act as holding portions. Overhang portions 115*a* project from the upper ends of the rear end portions of the holding portions 115 and extend toward each other. In addition, a connector casing 116 is provided to project from the lower surface on the front end of one side of the bottom portion 114 of the base body 111.

Contact terminals 112 and 113 are provided on mutually opposing sides and project from positions along the upper ends of the mutually facing surfaces of the holding portions 115 of the base body 111. The contact terminals 112 and 113 are, respectively, integrally formed with embedded portions (not shown) embedded in the base body 111, contact portions 112*a* and 113*a* which project from the holding portions 115, and contact pieces 112*b* and 113*b*. In addition, the contact terminals 112 and 113 are respectively formed with a plurality of (five in FIG. 18) contact projections 112*c* and 113*c* which are embossed in a generally hemispherical shape to project downward and are aligned longitudinally. The contact terminals 112 and 113 are pre-inserted (pre-accommodated) inside a die which is used for injection-molding the base body 111, so that while the base body 111 is being formed, the contact terminals 112 and 113 are, by insert molding, integrated in the base body 111 and are fixed to the base body 111. Accordingly, the above-described embedded portions and portions excluding the contact portions 112*b* and 113*b* projecting into the the connector casing 116 are embedded within the thickness of the base body 111.

The LED module 60 is installed in the base body 111 described above. More specifically, the side edge portions of the LED substrate 61 are, with the LED 62 facing upward, brought into the base body 111 of the power supply socket 110 from behind, through C-shaped channel sections that are formed by the bottom portion 114, the holding portions 115, and the overhang portions 115*a*. When the LED module 60 is completely inserted in the base body 111 of the power supply socket 110, the contact projections 112*a* and 113*a* of the contact terminals 112 and 113, particularly the contact projections 112*c* and 113*c* thereof, are brought into an elastic contact with the current-conducting parts 63 formed on the upper surfaces of the side edge portions of the LED substrate 61, so that the lower surfaces of the side edge portions of the LED substrate 61 are pressed against the bottom portion 114. As a result, the LED module 60 is assuredly held in the power supply socket 110.

Figure 19:
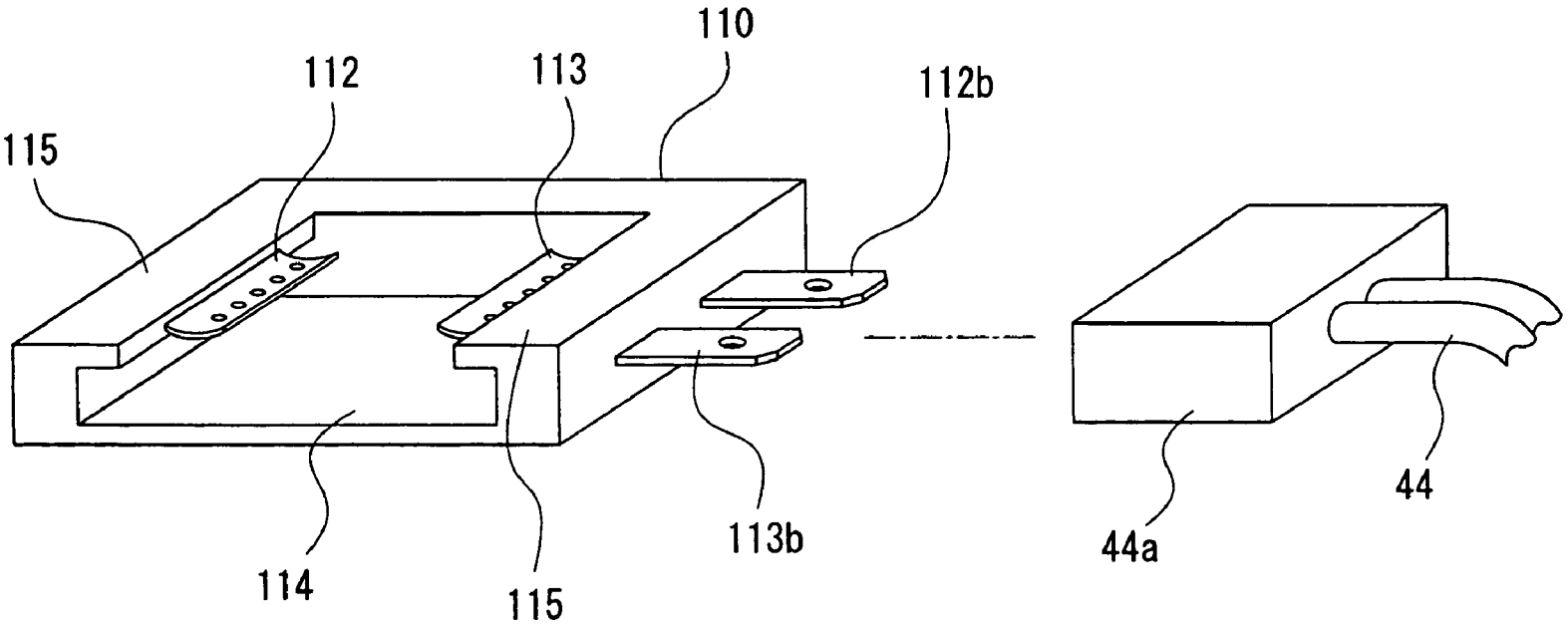
FIG. 19 is a perspective view of a still another modification of the power supply socket of the present invention.

FIG. 19 shows a still another modification of the power supply socket 110. A connector casing is not provided in this the power supply socket 110, and the terminal pieces 112*b* and 113*b* are instead exposed.

As seen from the above, according to the vehicular lamp of the present invention, the LED module and the power supply socket can be standardized, making it possible to reduce the manufacturing costs. In addition, attaching and detaching the LED module and the power supply socket is simple, and thus the lamp is easy for maintenance.

It should be noted that the shapes and structures of the respective parts illustrated in the above embodiments and modifications are all merely examples specified for carrying out the present invention and must not be viewed as limiting the technical scope of the present invention in any manner.

The invention claimed is:

1. A vehicular lamp comprising an LED module that is a light source of said vehicular lamp and a power supply socket for connecting the LED module to a power supply circuit, wherein said LED module comprises:

an LED substrate;

an LED mounted on the LED substrate; and a pair of current-conducting parts comprising positive and negative current-conducting parts which are connected to the LED and provided at opposing positions with the LED in between, and said power supply socket comprises:

a base body made from an insulating material and having a pair of holding portions into which LED substrate side edge portions formed with the current-conducting parts are inserted; and a pair of contact terminals comprising positive and negative contact terminals which are held in the holding portions of the base body and contact the pair of current-conducting parts of said LED module, and wherein when the LED substrate is installed in the holding portions of the base body of said power supply socket, the current-conducting parts of said LED substrate respectively contacts the pair of contact terminals and the LED substrate side edge portions are held by the holding portions; and wherein the LED substrate has a generally four-cornered outer shape and is provided with the current-conducting parts on opposing side edge portions thereof;

the pair of holding portions of the base body of said power supply socket is formed into a channel shape whose open surfaces face each other, and the LED substrate side edge portions formed with the current-conducting parts are held in the holding portions.

2. A vehicular lamp comprising an LED module that is a light source of said vehicular lamp and a power supply socket for connecting the LED module to a power supply circuit, wherein said LED module comprises:

an LED substrate;

an LED mounted on the LED substrate; and a pair of current-conducting parts comprising positive and negative current-conducting parts which are connected to the LED and provided at opposing positions with the LED in between, and said power supply socket comprises:

a base body made from an insulating material and having a pair of holding portions into which LED substrate side edge portions formed with the current-conducting parts are inserted; and a pair of contact terminals comprising positive and negative contact terminals which are held in the holding portions of the base body and contact the pair of current-conducting parts of said LED module, and wherein when the LED substrate is installed in the holding portions of the base body of said power supply socket, the current-conducting parts of said LED substrate respectively contacts the pair of contact terminals and the LED substrate side edge portions are held by the holding portions; and wherein the contact terminals of said power supply socket are made from a material having spring elasticity, and each of the contact terminals is formed with an elastic contact piece that elastically contact the LED substrate side edge portions formed with the current-conducting parts.

3. A vehicular lamp comprising an LED module that is a light source of said vehicular lamp and power supply socket for connecting the LED module to a power supply circuit, wherein said LED module comprises:

an LED substrate;

an LED mounted on the LED substrate; and a pair of current-conducting parts comprising positive and negative current-conducting parts which are connected to the LED and provided at opposing positions with the LED in between, and said power supply socket comprises:

a base body made from an insulating material and having a pair of holding portions into which LED substrate side edge portions formed with the current-conducting parts are inserted; and a pair of contact terminals comprising positive and negative contact terminals which are held in the holding portions of the base body and contact the pair of current-conducting parts of said LED module, and wherein when the LED substrate is installed in the holding portions of the base body of said power supply socket, the current-conducting parts of said LED substrate respectively contacts the pair of contact terminals and the LED substrate side edge portions are held by the holding portions; and wherein the base body of said power supply socket is provided with an opening that allows a top surface of the LED substrate that is an LED-mounted surface to be exposed.

4. The vehicular lamp according to claim 1, wherein the contact terminals of said power supply socket are made from a material having spring elasticity, and each of the contact terminals is formed with an elastic contact piece that elastically contact the LED substrate side edge portions formed with the current-conducting parts.

5. The vehicular lamp according to claim 4, wherein the base body of said power supply socket is provided with an opening that allows a top surface of the LED substrate that is an LED-mounted surface to be exposed.

* * * * *